United States Patent [19]

Czipri

[11] Patent Number: 4,993,343

[45] Date of Patent: Feb. 19, 1991

[54] FLUSH MOUNT SKI TOW HOOK

[76] Inventor: John Czipri, 229 Palm Island S.W., Clearwater, Fla. 34630.

[21] Appl. No.: 526,451

[22] Filed: May 21, 1990

[51] Int. Cl.[5] ..... B63B 21/10; B63B 21/58

[52] U.S. Cl. ..... 114/218; 24/115 R; 24/265 CD; 114/253; 248/499; 410/112

[58] Field of Search ..... 114/218, 249, 253 X; 24/115 R, 115 D, 265 CD; 248/499; 410/101, 109, 112, 113, 114, 115

[56] References Cited

U.S. PATENT DOCUMENTS

| | | | |
|---|---|---|---|
| 1,168,982 | 1/1916 | Walker | 114/218 X |
| 3,257,971 | 6/1966 | Swendson | 114/218 X |
| 3,694,866 | 10/1972 | Maier | 24/115 R X |

*Primary Examiner*—Sherman D. Basinger
*Attorney, Agent, or Firm*—Harold D. Shall

[57] ABSTRACT

A flush mount ski tow hook is mounted in a hole in the transom of a boat hull and has a sealing cup projecting inwardly of the hole from an externally mounted flange. The flange carries an inwardly and upwardly projecting tow hook. The sealing cup not only seals the opening in the transom but also seals the edges of the opening to protect the latter from the elements.

4 Claims, 1 Drawing Sheet

FLUSH MOUNT SKI TOW HOOK

BACKGROUND OF THE INVENTION

This invention relates to ski tow hooks generally and more particularly to a flush mount ski tow hook.

Ski tow hooks have been in wide spread use on boats for some time to facilitate the securing of the line used to tow a water skier to a boat. These ski tow hooks usually resemble the hook shown in U.S. Pat. No. 4,738,216 and project out from the surface of the boat transom or other part of the boat hull where they present a nuisance in that the projecting hook can be fouled, tripped over or bumped into by a boat occupant thereby causing an injury.

U.S. Pat. No. 3,747,554 disclosed a flush mounted hook, but this is not the type of a hook which can be mounted through the hull, for example, through a hole in the transom, and seal the hole so that water cannot enter the hull and further seal the edges of the hole so that these edges are protected from the elements.

U.S. Pat. No. 3,257,971 discloses a non protruding cleat, however this cleat fits entirely within the opening the line passes through and the edges of the opening, for example at the location shown by the numeral 23 are not protected from the elements but, rather are exposed and subject to attack.

SUMMARY OF THE INVENTION

It is an object of this invention to provide a flush mount ski tow hook which is mounted in a hole in the boat hull and has a sealing cup projecting inwardly of the hole from an externally mounted flange, which flange carries the inwardly projecting hook, and where the cup not only seals the hull opening, hut also seals the edges of the opening to protect the latter from the elements.

DETAILED DESCRIPTION

Figure 2:
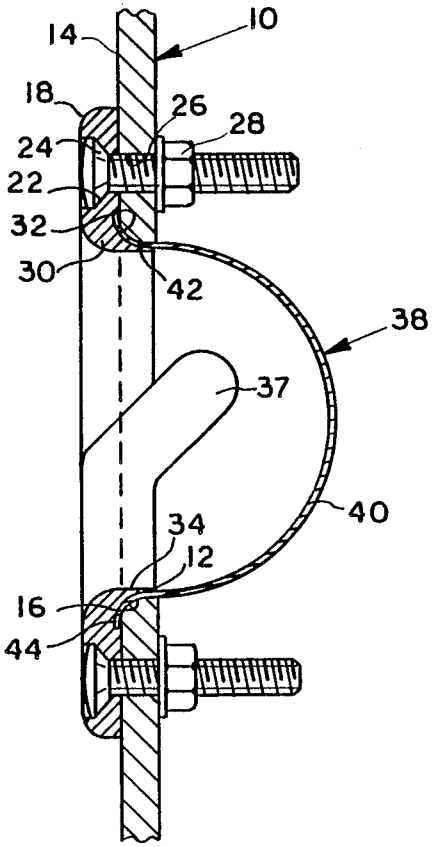
FIG. 2 is a sectional view taken along the lines 2—2 of FIG. 1, with some portions shown in full lines and with the ski tow mounted on the transom of a boat hull.
Figure 1:
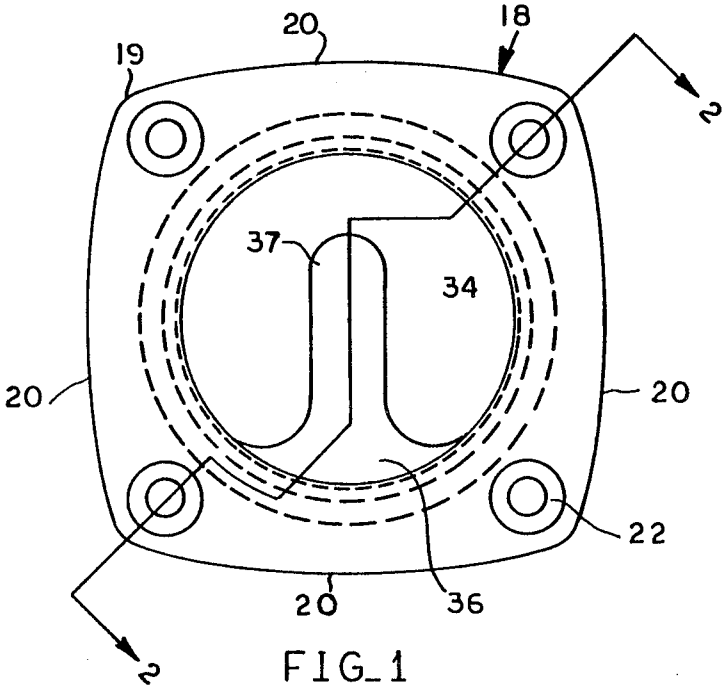
FIG. 1 is a front elevational view of a flush mount ski tow of this invention.

Referring now to the drawings, a transom of a boat hull is shown generally at 10 and has round opening 12 extending therethrough with the left or outer face 14 of the transom curved as seen at 16. A generally square flange 18, which has rounded corners 19 and is slightly curved at 20 between the corners, has a bolt opening 22 formed in each corner thereof. A bolt 24 passes through each opening 22 and through a registering opening 26 formed in the transom. A washer is placed on the bolt 24 internally of the transom and a nut 28 secures the flange 18 to the transom.

The flange 18 is formed with an annular turned in lip 30 which extends into the round opening 12 in the transom in a spaced relationship relative thereto, and the flange as shown at 32 is formed with an annular grove with overlies, in a spaced relationship, the transom at a location surrounding the opening 12 therein.

The lip 30 in the flange 18 surrounds a round opening 34 formed in the flange 18. At the bottom of the opening 34, as seen at 36, an inwardly and upwardly projecting tow hook 37 projects from the flange 34 and extends inwardly of the transom 10.

A sealing cup 38 connects to the flange 18 and seals the opening in the transom. More particularlY, the cup 18 has a hemispherical portion 40 which projects through the transom opening 12 and extends beyond the inner end of the tow hook 37 an amount sufficient to allow a loop on the end of the ski tow line to pass over the hook 37 and between the hook and cup 40.

The perimeter of the cup as shown at 42 abutts at its inner surface the opening 12 in the transom 14 and is curved to match the curve 16 of the transom 14. The cup 38 has an annular flange 44 at its outer end (its left end as seen in FIG. 2) which flange 44 is sealingly and securely received in the annular groove 32 formed in the flange 18 and pressed against the adjoining surface of the transom 14.

Although the above description relates to a presently preferred embodiment, modifications can be made therein without departing from the spirit of the invention as defined in the following claims.

What is claimed is:

1. A flush mount ski tow hook for mounting in conjunction with a hole formed in the transom of a boat hull comprising;

(a) a flange bolted to said transom externally thereof, (b) said flange having an opening therein in registration with the opening in the transom, (c) a lip formed on said flange and projecting into said opening in spaced relationship thereto, (d) a groove formed in said flange and extending about the periphery of the opening in said flange and overlying the external surface of the transom adjacent the opening in the transom, (e) a ski tow hook formed on said flange at the base of said opening therein and extending inward of the transom and upwardly of said flange, (f) a cup shaped sealing element projecting inwardly of the transom and overlying said tow hook, (g) said cup element abuttingly and sealingly engaging the opening in the transom, and (h) said cup element having peripheral flange formed thereon in sealing registration with the said groove formed in said flange.

2. A ski tow hook according to claim 1 wherein said lip on said flange overlies and securely engages the internal periphery of said cup element adjacent the flange on said cup element.

3. A ski tow hook according to claim 2 wherein the hole in the transom is round and the cup shaped sealing element is hemispherical.

4. A ski tow hook according to claim 1 wherein the hole in the transom is round, and the cup shaped sealing element is hemispherical.

* * * * *